US007234407B1

(12) United States Patent
Levine et al.

(10) Patent No.: US 7,234,407 B1
(45) Date of Patent: Jun. 26, 2007

(54) ACTIVE ANTI-FOULING SYSTEMS AND PROCESSES FOR MARINE VESSELS

(75) Inventors: Robert A. Levine, Houston, TX (US); Joseph P. Madden, Long Beach, CA (US); A. Stefan Bern, Katy, TX (US); Michael Leer-Andersen, Gothenburg (SE)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 11/311,955

(22) Filed: Dec. 19, 2005

(51) Int. Cl.
*B63B 59/00* (2006.01)
*E02D 5/60* (2006.01)

(52) U.S. Cl. ..... 114/222; 405/216

(58) Field of Classification Search ..... 114/222; 405/216

See application file for complete search history.

(56) References Cited

U.S. PATENT DOCUMENTS

| | | | |
|---|---|---|---|
| 3,241,512 | A | 3/1966 | Green |
| 3,303,118 | A | 2/1967 | Anderson |
| 3,544,442 | A | 12/1970 | Anderson |
| 3,625,852 | A | 12/1971 | Anderson |
| 3,984,302 | A | 10/1976 | Freedman et al. |
| 4,256,556 | A | 3/1981 | Bennett et al. |
| 4,345,981 | A | 8/1982 | Bennett et al. |
| 4,513,029 | A | 4/1985 | Sakai |
| 5,322,569 | A | 6/1994 | Titus et al. |

FOREIGN PATENT DOCUMENTS

| | | |
|---|---|---|
| WO | WO 00/60138 | 10/2000 |

OTHER PUBLICATIONS

Powell Fabrication & Manufacturing Inc., "*Sodium Hypochlorite—General Information Handbook*", Apr. 8, 2002.
Wallace & Tiernan Products, "*Recommendations for Preparing, Handling and Feeding Sodium Hypochlorite Solutions*" Sep. 2000.
Emerson Process Management, Rosemount Analytical, "*Theory—Chlorine Measurement By Amperometric Sensor*", Aug. 2004.

*Primary Examiner*—Jesús D. Sotelo
(74) *Attorney, Agent, or Firm*—Baker & McKenzie LLP

(57) ABSTRACT

Systems and processes for controlling and/or preventing fouling of marine vessel hulls and fixed structures are disclosed. The systems and processes deliver an anti-fouling composition through a dispersing means, such as dispersion tubing, to the surface of a vessel hull or fixed structure below the water line. Also disclosed are methods of controlling the delivery of an anti-fouling composition to the surface of a vessel hull or fixed structure below the waterline, including the steps of generating signals representative of parameters such as current flow direction and speed and water temperature, to identify and control the proper volume release rate of the anti-fouling solution.

21 Claims, 3 Drawing Sheets

ACTIVE ANTI-FOULING SYSTEMS AND PROCESSES FOR MARINE VESSELS

FIELD OF THE DISCLOSURE

This disclosure relates to systems and processes for control and prevention of fouling of marine vessel hulls, including anchored and/or moored vessels such as floating storage vessels (FSOs) and floating production vessels (FPSOs), as well as fixed structures. Specifically, the systems and processes described herein relate to preventing fouling of marine vessel hulls and structures by the controlled release of an anti-fouling composition through dispersion tubing adjacent to the vessel hull or structure.

BACKGROUND OF THE DISCLOSURE

Fouling of marine vessel hulls and other structures in a marine environment has always been a serious problem. The formation of incrustations of barnacles, tunicates, and like fouling organisms, will increase the vessel's weight, thereby decreasing the available storage space, slow a vessel underway, increase its fuel consumption, and make it difficult to handle, thus reducing the vessel's performance and efficiency. On fixed structures, fouling increases weight, and thus structural loading. Fouling also damages the vessel hull base paint, thereby exposing the hull to corrosion.

Vessel hull fouling can be removed while the vessel is in place or in dry-dock using mechanical and/or chemical means. However, these alternatives are frequently unavailable, or are available only after a long wait. When a vessel hull or structure is cleaned in place, it is common practice to use divers, however there are inherent dangers whenever a diver enters the water. Additionally, damage may occur whenever a diver cleans a hull or structure. When a vessel hull is cleaned in dry-dock, the vessel must be taken out of service to the nearest available dry-dock, which usually results in substantial adverse financial consequences due to the costs, not only for the required work, but also for the off-hire time. Furthermore, removal of incrustations of marine organisms while at dock can raise significant regulatory and environmental concerns. It is impractical to remove fixed structures from site for cleaning.

Remedies that have previously been tried include using toxic paints that slowly release such marine growth inhibitors such as copper or tin salts, or using silicone based paints, which are ultra-smooth, making it difficult for fouling organisms to adhere to the surface of the vessel hull. These methods are effective until the inhibitors are leached from the paint, or the paint is damaged, and fouling takes place again, requiring dry-docking of the vessel to remove the fouling material and to repaint the hull. Also, these anti-fouling agents remain in the marine environment for a long period of time. Therefore, the most toxic of the anti-fouling coatings are being banned worldwide and are being replaced by less toxic, but also less effective coatings. For structures and vessels expected to operate in a marine environment for a long period of time, such as FSOs or FPSOs, fouling is an even greater problem.

Another approach for controlling and preventing marine fouling involves using an anti-fouling system that includes a pair of electrodes positioned on opposite sides of the keel of a vessel, and a means for supplying an electrical current to the electrodes. The electrolysis of sea water produces toxic agents such as chlorine and sodium hypochlorite adjacent the vessel hull that remove barnacles, algae, fungi and other marine growths.

However, such systems do not provide predictable control of the concentration of anti-fouling composition delivered to the hull. In addition, the electrodes require regular maintenance, which may be difficult since the electrodes are positioned on the outside of the vessel hull adjacent the keel.

BRIEF DESCRIPTION OF THE DISCLOSURE

Systems and processes for the prevention of fouling of marine vessel hulls and structures, including vessels used for floating storage (FSOs) and production (FPSOs), without the need to take the vessels or structures out of the water, are disclosed. The process involves the controlled release of an anti-fouling composition released below the water line in a manner that contacts a sufficient portion of the surface area of the vessel or structure that is below the water line with the anti-fouling composition for a sufficient amount of time to prevent fouling. For simplicity, the portion of the surface area of the vessel hull or structure that is below the water line is sometimes hereinafter referred to as "surface of the vessel hull or structure" or as the "surface area of the vessel hull or structure," however these phrases should be understood to mean the portion of the surface area of the vessel hull or structure that is below the water line.

In aspect, embodiments of the invention provide a process for delivering an anti-fouling composition, wherein the process includes delivering an anti-fouling composition to an underwater surface, particularly an underwater surface of a vessel hull, at an effective, anti-fouling dosage to at least 60% of the surface area of the underwater surface for a period of at least two minutes, wherein the anti-fouling composition is delivered to the underwater surface through a plurality of openings disposed along at least one tubing member having a longitudinal dimension and a transverse dimension. In some embodiments, the process further includes generating the anti-fouling composition on-board the structure, particularly where the structure is a ship or other marine vessel. Some embodiments of the processes described herein may be suitably carried out with the structures described herein.

Thus, in another aspect, embodiments of the invention provide a structure that includes an underwater surface; at least one tubing member having a longitudinal axis and a plurality of openings disposed along the longitudinal axis of the tubing member, the tubing member being positioned adjacent to the underwater surface; and a means for supplying an anti-fouling composition to the surface through the tubing member. In particular embodiments, the underwater surface is at least a portion underwater surface of a vessel hull.

In certain embodiments, the underwater surface of the structure is a portion of the underwater surface of a vessel hull. Whether the structure is a vessel or another structure having an underwater surface, some embodiments further comprise a means for producing the anti-fouling composition.

Some embodiments of the invention include a plurality of tubing members having a combined longitudinal dimension from about 0.006 $m/m^2$ of underwater surface area to 0.06 $m/m^2$ of underwater surface area. In other embodiments, the tubing members have from about 0.0915 openings per square meter of surface area to about 0.197 openings per square meter of surface area of underwater surface to be treated. Particular embodiments having such tubing or opening configurations are used on the underwater portion of a vessel hull.

Independently of the longitudinal dimension, some embodiments of the invention include a plurality of tubing members wherein the plurality of openings are configured such that the system is capable of delivering the anti-fouling composition at an effective dosage to at least 60% of the surface area of the underwater surface for a period of at least two minutes. In other embodiments, the tubing members are configured to deliver an effective dosage of the anti-fouling composition to at least 75% to 90% of the surface area of the underwater for a period of at least 60 minutes. Typically, the percentage of the surface area is determined using a computational fluid dynamics model, but any other suitable method can be used. Some tubing members have a "hole density" (the number of holes per square meter of the surface area of the underwater surface) ranging from about 0.0915 opening per square meter to about 0.197 opening per square meter.

Any anti-fouling composition may be used. One suitable anti-fouling composition comprises sodium hypochlorite or reaction products of sodium hypochlorite with water. Some such anti-fouling compositions include a solution of sodium hypochlorite capable of providing at least 0.2 ppm available chlorine to the underwater surface.

In another aspect, embodiments of the invention provide a system for delivering an anti-fouling composition. Embodiments of such systems include a means for delivering an anti-fouling composition to at least one tubing member positioned adjacent to an underwater surface of a marine structure or vessel. Typically, the at least one tubing member comprises a plurality of openings of suitable size and at suitable locations such that the at least one tubing member is capable of delivering an effective dosage of the anti-fouling composition to at least 60% of the underwater surface. In some embodiment, tubing members having a combined longitudinal dimension from about 0.006 $m/m^2$ of underwater surface area to 0.06 $m/m^2$ of underwater surface area are particularly suitable, especially where they are configured to provide a sodium hypochlorite solution capable of providing at least 0.2 ppm available chlorine to the underwater surface.

In still another aspect, embodiments of the invention provide a method of determining an appropriate amount of an anti-fouling composition to be delivered an underwater surface of a vessel hull. In particular embodiments, the methods include generating a first signal representative of a current flow direction of the water in which the vessel is positioned; generating a second signal representative of a current flow speed of the water in which the vessel is positioned; generating a third signal representative of a temperature of the water in which the vessel is positioned; and using the first signal, the second signal, and the third signal to generate a fourth signal representative of the volume of an anti-fouling composition to be released.

In some embodiments, the method determines the volume of the anti-fouling composition to be released from a delivery system provides an anti-fouling composition at an effective dosage to at least 60% of the surface area of the underwater surface of the vessel hull. In some embodiments, the method determines the volume of a sodium hypochlorite solution capable of providing at least 0.2 ppm available chlorine that should be dispersed.

DETAILED DESCRIPTION OF EMBODIMENTS OF THE INVENTION

Figure 1:
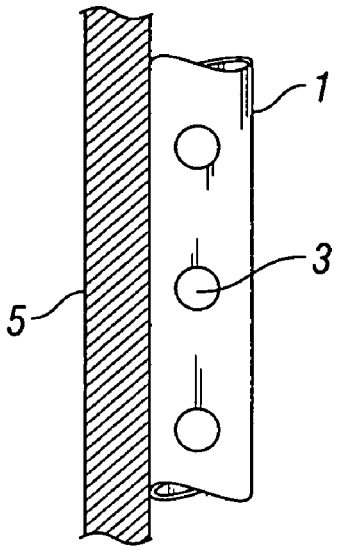
FIG. 1 is view of a section of dispersion tubing in accordance with an embodiment of the systems described herein.

Systems and processes are disclosed for preventing and/or controlling fouling of marine vessel hulls and fixed structures, including vessels used for floating storage (FSOs) and production (FPSOs) without the need to take the vessels or structures out of the water.

The systems and processes relate to the controlled release of an anti-fouling composition about the surface of the vessel hull or structure. It has been discovered that, by carefully controlling the release of the anti-fouling composition about the vessel hull, it is possible to prevent or control the growth of marine organisms on the surface without taking the vessel or structure out of service. The systems and processes described herein can be used to prevent or control fouling of a vessel hull while the vessel is anchored or moored, or while the vessel is underway. The systems and processes described herein do not require the use of divers and/or placement of auxiliary equipment in the water (other than a dispersing means for the anti-fouling solution), as is necessary for removal of fouling once it occurs.

As discussed above, the systems and processes described herein disperse an anti-fouling composition about the surface of a vessel hull or fixed structure. The systems can include a production and/or storage means for producing and/or storing the anti-fouling solution, a transport means for transporting the solution from the production and/or storage means to a dispersing means, and a dispersing means, such as a dispersion tubing member having a plurality of openings, for dispersing the anti-fouling composition to the surface of the vessel hull or structure.

A. Anti-Fouling Solutions

The anti-fouling composition is any solution that can prevent and/or control fouling on the surface of the vessel hull or structure. A sodium hypochlorite solution is one example of an anti-fouling solution. The anti-fouling effect of a sodium hypochlorite solution is due to "available chlorine," a measure of the oxidizing capacity of the sodium hypochlorite expressed in terms of chlorine. "Available chlorine" can be calculated by multiplying the sodium hypochlorite concentration by the ratio of the molecular weight of chlorine to the molecular weight of sodium hypochlorite (i.e. multiplying by the ratio 70.9/74.5). For example, the available chlorine ($Cl_2$) concentration of a 2000 ppm solution of sodium hypochlorite (NaOCl) can be calculated as follows:

$$2000 \text{ ppm NaOCl} \times (70.9/74.5) = 1903 \text{ ppm available } Cl_2$$

The concentration of sodium hypochlorite required to combat marine fouling is low. Any desirable concentration may be used. While lower concentrations may be used, an effective concentration of an anti-fouling compositions, such as one that includes sodium hypochlorite, typically provides at least about 0.2 ppm available chlorine in the water surrounding the vessel hull or structure surface to prevent or control fouling. Of course lower concentrations may not be as effective. In certain embodiments, a sodium hypochlorite solution which provides at least about 0.4 ppm available chlorine concentration in the water surrounding the vessel hull or structure surface can be used, and in still other embodiments, a sodium hypochlorite solution which provides at least about 0.6 ppm available chlorine concentration in the water surrounding the vessel hull or structure surface can be used. Higher concentration of sodium hypochlorite may be used, it may not be necessary and may raise environmental concerns.

Compositions comprising anti-fouling agents other than sodium hypochlorite may be used with the systems and processes described herein, including for example, compounds capable of producing hypohalous acids in solution.

In some embodiments, the invention anti-fouling composition can be generated on-site. For example, in embodiments using an anti-fouling composition comprising sodium hypochlorite, electrolytic conversion of sodium chloride in seawater can be performed to generate the sodium hypochlorite. On-site production of sodium hypochlorite reduces or eliminates costs and other issues associated with transportation and storage of hazardous chemicals. It also reduces or eliminates handling of bulk corrosive materials, since the sodium hypochlorite may be handled in a closed piping system. Personnel on the vessel or structure may be easily trained to operate and maintain the sodium hypochlorite generating systems. Further, it reduces or eliminates environmental concerns because sodium hypochlorite is effective to combat marine fouling in low concentrations, it reverts to salt and water within a short time, and it does not leave residuals detrimental to the environment.

B. Storage/Production of the Anti-Fouling Solution

Any vessel that can store an appropriate quantity of the anti-fouling composition for use in the systems and processes described herein can be used. Ideally, the storage vessel will resist corrosion when contacted with the anti-fouling solution. Those of skill in the art can readily select an appropriate storage vessel taking the nature of the anti-fouling composition into consideration.

In embodiments where the anti-fouling composition includes sodium hypochlorite, the storage vessel may also include the appropriate electrolytic equipment, for example, copper or other suitable electrodes and a means for supplying an electric current to the electrodes. The hypochlorite concentration can be measured using techniques well known to those of skill in the art.

C. Transport and Pumping Means

Any type of transport means, such as piping, and any type of pump which are not corroded by the anti-fouling composition can be used to transport the anti-fouling composition from the production or storage unit to the dispersing means that ultimately delivers the anti-fouling composition to the surface of the vessel hull or structure. Representative materials for use in pipes include stainless steel, titanium, fiberglass, PVC and other plastic materials, and a variety of other corrosion resistant piping materials.

D. Dispersing Means

The anti-fouling composition can be dispersed to the surface of the vessel hull or structure using any of a variety of dispersing means. The dispersing means must be able to provide the anti-fouling composition to a suitable portion, generally at least about 60%, of the surface of the vessel hull or structure such that fouling is prevented and/or controlled.

In one embodiment, the dispersing means comprises at least one tubing member having a plurality of openings, where the passage of the anti-fouling composition through the openings delivers the solution to the surface of the vessel hull or structure.

The tubing members can be made from a variety of materials. Exemplary materials are fiberglass, PVC, stainless steel, titanium, and a variety of other corrosion resistant piping materials. The thickness of the materials in the tubing members can range from about 0.05 mm to about 12 mm. The diameter of the tubing member can be up to 200 mm. In certain embodiments, the diameter of the tubing member is from about 25 mm to about 50 mm. In other embodiments, the diameter of the tubing member is from about 50 mm to about 100 mm. In still other embodiments, the diameter of the tubing member is from about 100 mm to about 150 mm. The cross section of the tubing members can be a variety of shapes. In certain embodiments, the cross section is circular. In other embodiments, the cross section is a half circle. In certain of these embodiments, when the cross section is a half circle, the flat side of the tubing member can be disposed towards the surface of the vessel hull. In other embodiments, the cross section of the tubing member is elliptical.

In certain embodiments, the anti-fouling composition is released through a plurality of openings in at least one tubing member positioned adjacent to the surface area of the vessel hull or structure, and is released at a pressure of from about 1.5 kPa to about 280 kPa above the hydrostatic pressure existing at the plurality of openings. Of course, it is understood that the hydrostatic pressure at the plurality of openings will vary with the depth of water at a particular opening. In other embodiments, the anti-fouling composition is released through the plurality of openings at a pressure of from about 2 kPa to about 100 kPa above the hydrostatic pressure existing at the plurality of openings. In additional embodiments, the anti-fouling composition is released through the plurality of openings in the at least one tubing member at a pressure of from about 5 kPa to about 75 kPa above the hydrostatic pressure existing at the plurality of openings.

As will be appreciated, there are many different sizes and shapes of vessel hulls and fixed structures. This being the case, it is apparent that the systems described herein can be provided in a variety of configurations to ensure delivery of an effective dosage of the anti-fouling solution. The systems ideally include at least one tubing member having a longitudinal axis and a transverse axis, each such tubing member having a plurality of openings disposed along the longitudinal axis of the tubing member. At least a portion of each such tubing member is positioned below the waterline and adjacent to the surface of the vessel hull or structure. The spacing, size, and shape of the openings in the tubing member may vary depending on the surface area of the vessel hull or structure to be covered and the volume of the anti-fouling composition desired to be released from the tubing member.

Figure 2:
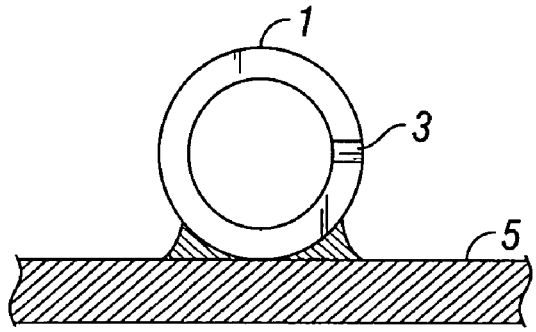
FIG. 2 is cross-sectional view of a section of dispersion tubing in accordance with an embodiment of the systems described herein.

FIG. 1 depicts a section of an exemplary tubing member 1 in which openings 3 are spaced along the longitudinal axis of the tubing member. The tubing member 1 is disposed below the waterline and adjacent to the surface of a vessel hull or structure 5. FIG. 2 provides a cross-sectional view of the view of the same embodiment depicted in FIG. 1. The tubing member 1, when positioned below the waterline and adjacent to the surface of the structure or vessel hull, can be in contact with the vessel hull or structure surface or can be positioned up to 12 mm from the surface of the structure or vessel hull. Generally, it is desirable to position the tubing member so that the anti-fouling composition is released into the boundary layer in the water that exists along the surface of a vessel hull or structure, if either the hull is moving or the water surrounding the hull is moving relative to the hull, as for instance a moored ship in a current. The boundary layer is the region of turbulent flow adjacent to the vessel hull or structure created as water flows past the surface of the hull or structure. Releasing the anti-fouling composition into the boundary layer reduces the tendency of the anti-fouling composition to be carried away from the vessel hull or structure and helps keep the anti-fouling composition in contact with the surface of the vessel hull.

In the embodiment depicted in FIG. 1 and FIG. 2, the openings 3 are positioned so that the flow of the anti-fouling composition out of the openings 3 is parallel to the surface of the vessel hull or structure. However, it is understood that the openings in the tubing member may be positioned at various angles relative to the surface of the vessel hull, although generally it is desirable to position the axis of the release hole (opening) so that the anti-fouling composition is not delivered in the wake downstream of the tubing member, i.e., so that the anti-fouling composition is delivered outside of the wake area.

In one embodiment, the openings are generally circular in shape, with diameters of about 2 mm to about 15 mm, and at least 80% of the centers of the openings are spaced about 20 cm to about 50 cm apart. In another embodiment, the openings have diameters of about 3 mm to about 10 mm and at least 80% of the centers of the openings are spaced about 25 cm to about 40 cm apart. In other embodiments, the openings have diameters of about 4 mm to about 8 mm and at least 80% of the centers of the openings are spaced about 30 cm to about 40 cm apart. For Computational Fluid Dynamics ("CFD") modeling purposes herein, a continuous opening or slot was used to model the release for Examples 1 and 2, whereas, in actuality, because of strength considerations, a series of holes or slots will most likely be utilized, as was modeled in Examples 3-5.

E. Arrays of Dispersing Means

Figure 3:
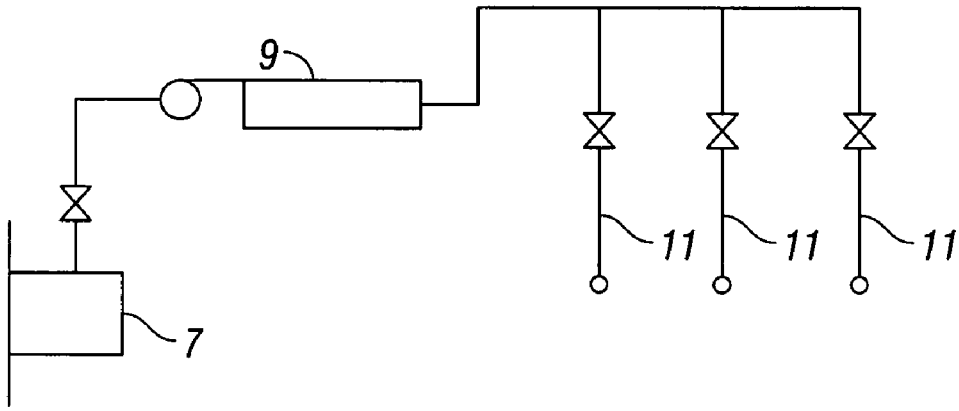
FIG. 3 is a schematic diagram of an embodiment of the systems described herein.

Because of the complex geometry of vessel hulls and fixed structures, it is typically necessary to provide an array (or plurality) of dispersing means, such as tubing members, to achieve delivery of an effective dosage of the anti-fouling composition to the surface of the vessel hull or structure. FIG. 3 provides a schematic representation of a system in accordance with this disclosure in which an array of tubing members is provided. The system depicted in FIG. 3 includes equipment for producing an anti-fouling solution. Specifically, a sea chest 7 is used as a source of seawater that is pumped to a sodium hypochlorite generator 9. Sodium hypochlorite solution is then pumped through the array of tubing members 11, from which the sodium hypochlorite solution is released through a series of openings (not shown) as previously described. Storage tanks may be used to allow for the accumulation of the sodium hypochlorite so that the generator can be run at a constant rate, and dosing may be administered at varying time intervals.

In certain embodiments, the systems and processes described herein are capable of delivering, via the dispersing means, an anti-fouling composition at an effective dosage to at least about 60% of the surface area of the vessel hull or structure. In other embodiments, the systems and processes described herein are capable of delivering an effective dosage of the anti-fouling composition to at least about 75% of the surface area of the vessel hull or structure. In still other embodiments, the systems and processes described herein are capable of delivering an effective dosage of the anti-fouling composition to at least 90% of the surface area of the vessel hull or structure.

In certain embodiments, the effective dosage of the anti-fouling composition is delivered for at least one continuous period of at least 2 minutes in a 24 hour period to provide anti-fouling results. In other embodiments, the effective dosage of the anti-fouling composition is delivered for at least one continuous period of at least 30 minutes in a 24-hour period to provide anti-fouling results. In additional embodiments, the effective dosage of the anti-fouling composition is delivered for at least one continuous period of at least 60 minutes in a 24-hour period to provide anti-fouling results.

The configuration of the array of tubing members necessary to deliver the desired concentration of the anti-fouling composition to the surface of the vessel hull or structure is, of course, dependent on the size and geometry of the vessel hull or structure on which the array is installed. The configuration of the array is also dependent on the structure or vessel's service. For installations on most vessels, it is necessary to include at least one tubing member in which the longitudinal axis of the tubing member is oriented along the length of the vessel hull, i.e., along an axis extending from the bow to the stern of the vessel. Additionally, for most vessels, it is generally desirable to include at least one tubing member in which the longitudinal axis of the tubing member is oriented along the width of the vessel hull, i.e., along the transverse axis extending from the starboard side to the port side of the vessel. In many embodiments, a plurality of tubing members oriented along both axes is desirable. Although the orientation of the longitudinal axis of the tubing members is described as extending along either the length or the width of the vessel hull, it is understood that the tubing members may be positioned at angles to those axes. Generally, it is intended that at least one tubing member extends along at least a portion of the axis extending from the bow to the stern of the vessel hull and at least one tubing member extends along at least a portion of the axis extending from the starboard to the port side of the vessel hull. Tubing members can also be positioned at varying points along the length of the vessel's hull and/or may be positioned along the vertical axis of the vessel hull, i.e., along an axis extending from the water line to the bottom of the vessel hull.

The spacing between the tubing members within the array of tubing members may vary depending on the desired concentration of the anti-fouling composition at the surface of the vessel hull and other factors such as current flow around the hull. In one embodiment, the longitudinal axes of the tubing members are spaced from about 5 m to about 150 m apart. In another embodiment, the longitudinal axes of the tubing members are spaced from about 5 m to about 100 m apart. In a third embodiment, the longitudinal axes of the tubing members are spaced from about 10 m to about 30 m apart.

F. Attachment of the Dispersing Means to the Vessel Hull

The dispersing means, for example, tubing members, can be attached adjacent to the vessel hull by any of a variety of methods. The means for attaching the tubing members can be applied to other dispersing means as well. For example, the tubing members, can be attached directly to the hull surface or by attaching welded studs to the hull and strapping the tubing members to the studs. Alternatively, pipe hangers may be welded to the hull and the tubing members then attached by securing the tubing members in the hangers. Other common methods for securing tubing can also be used.

As discussed, the spacing of the tubing members may vary. One way to provide efficient coverage of the vessel hull with the anti-fouling composition can be achieved by an array of a combination of longitudinal and transverse tubing members. The most efficient array for a particular hull or structure under specific service and water conditions may be determined using CFD mathematical modeling techniques. By positioning the tubing members in such an array, it is generally found that there is an optimal or preferred relationship between combined linear dimensions, in other words between the combined longitudinal dimensions of the tubing members in the array and the surface area of the vessel hull. In certain embodiments, the relationship of the combined linear dimensions of the tubing members to the surface area of the vessel hull or structure is from about 0.006 $m/m^2$ of underwater surface area to 0.06 $m/m^2$ of underwater surface area. In other embodiments, the relationship of the combined linear dimensions of the tubing members to the surface area of the vessel hull or structure is from about 0.008 $m/m^2$ of surface area to about 0.08 $m/m^2$ of surface area. In additional embodiments, the relationship of the combined linear dimensions of the tubing members to the surface area of the vessel hull or structure is from about 0.01 $m/m^2$ of surface area to 0.1 $m/m^2$ of underwater surface area.

In certain embodiments, there is also an optimal or preferred relationship between the total number of openings in all of the tubing members of the system and the surface area of the vessel or hull. In certain embodiments, the number of total openings per square meter of surface area ranges from about 0.0915 opening per square meter of surface area to about 0.197 opening per square meter of surface area. In other embodiments, the number of total openings per square meter of surface area ranges from about 0.05 opening per square meter of surface area to about 0.40 opening per square meter of surface area. In still other embodiments, the number of total openings per square meter of surface area ranges from about 0.025 opening per square meter of surface area to about 0.80 opening per square meter of surface area.

G. Selection of Effective Dosage of the Anti-Fouling Solution

As discussed above, there are many variables that come into play in providing a release of an effective dosage of the anti-fouling composition from the tubing members. In addition to the size and geometry of the structure or vessel hull, flow conditions such as the speed and direction of the water movement about the surface of the structure or vessel hull are factors to be considered in achieving delivery of an effective dosage of the anti-fouling solution. The speed and direction of the water flow is the cumulative effect of currents, wind, tides, and vessel movement. Additionally, conditions such as temperature and vessel hull draft are also factors.

Some or all of these various conditions are taken into account in controlling the delivery of an anti-fouling composition to the surface area of the vessel hull or structure. Process control systems can be provided which take into account some or all of the conditions described above. The process control methods include steps of generating signals representative of one or more parameters such as current flow direction, current velocity, and temperature of the water in which the vessel hull is positioned, to generate a signal representative of the volume of the anti-fouling composition to be released from an anti-fouling composition delivery system in order to deliver the desired concentration of the anti-fouling composition to the surface of the vessel hull. The systems and processes can be controlled, for example, using a stand-alone or integrated programmable logic controller ("PLC"). The PLC may be used to monitor selected parameters and to ultimately send signals to valves, motors, motor starters, etc. to regulate the release of the anti-fouling solution.

A wide variety of input parameters may be used to control the systems and processes described herein. Many of the parameters that may be considered are discussed above. Additional parameters that can be considered include water turbidity, water salinity, direct measurement of anti-fouling composition concentration in the water about the surface of the structure or vessel hull, concentration of the anti-fouling composition, current direction and velocity, pressures, and tides.

In certain embodiments, control of release of an anti-fouling composition is controlled by generating a series of signals to provide a feedback control mechanism as follows:

(i) generating a first signal representative of a current flow direction of the water in which the vessel is positioned;

(ii) generating a second signal representative of a current flow speed of the water in which the vessel is positioned;

(iii) generating a third signal representative of a temperature of the water in which the vessel is positioned; and (iv) using the first signal, the second signal, and the third signal to generate a fourth signal representative of the volume of anti-fouling composition necessary to be released from the system to deliver the anti-fouling composition at an effective concentration, such as for sodium hypochlorite at a concentration of from about 0.2 ppm to about 2 ppm, for at least one minute to at least 60% of the surface area of vessel hull.

The present invention will be better understood with reference to the following non-limiting examples.

EXPERIMENTAL EVALUATIONS

Experimental evaluations of various systems and processes in accordance with this disclosure were conducted by SSPA Sweden AB using CFD modeling. The following are exemplary embodiments of systems and processes described herein and determined by CFD modeling to be capable of delivering an effective amount of the anti-fouling composition to at least 60% of the surface area of vessel hull. Higher coverage, i.e., close to 100% coverage of the surface area, is obtained in Examples 3-5. The surface area coverage and the release rate of the anti-fouling composition required to provide an effective amount of the anti-fouling composition at the surface of the vessel hull in these exemplary embodiments is in each case calculated using CFD modeling.

In all of the embodiments described below, CFD modeling is based on a vessel having a length of 258 m, a breadth of 52 m, and a maximum draft of 18.25 m. The surface area of the vessel hull below the waterline at maximum draft is calculated to be about 22,800 $m^2$.

All calculations shown in the embodiments described below are based on a modeled release of an anti-fouling composition of sodium hypochlorite in seawater. The CFD calculations assume that the sodium hypochlorite solution release is continuous for a period of at least one minute. All conditions in the following embodiments are optimized and deliver a sodium hypochlorite concentration of at least 2 ppm over at least 60% of the surface of the vessel hull below the waterline.

Examples 1-2

In Examples 1 and 2, modeling was performed with the assumption that the vessel is moored with a turret moor, allowing the vessel to rotate with current and wind so that the angle of the flow of water is always along the centerline of the vessel hull. Further, in Examples 1 and 2, modeling was performed with the assumption that the anti-fouling composition released has a concentration of sodium hypochlorite of 0.00200 kg sodium hypochlorite/kg seawater.

Figure 4:
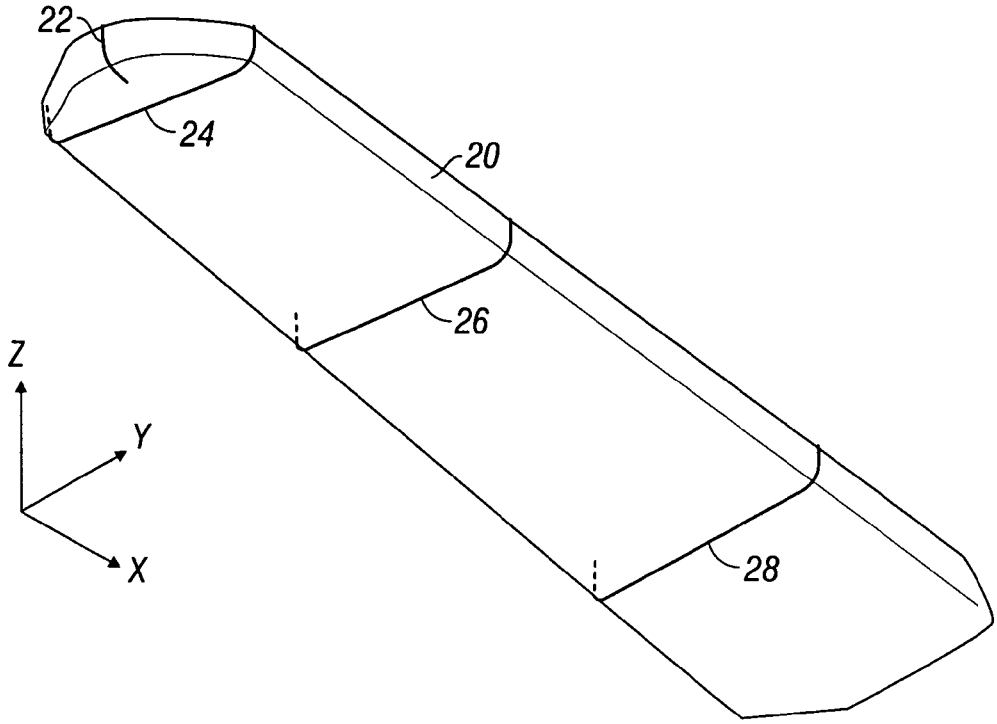
FIG. 4 is a depiction of an embodiment of an anti-fouling composition release system.

Example 1 describes the performance of an exemplary anti-fouling system for a water current velocity of 2.5 m/s and a hull draft of 14.5 m. In the modeled system, a vessel hull 20 is provided with one centerline tubing member 22 and three transverse tubing members 24, 26, and 28 as depicted in FIG. 4. In this example, the centerline tubing member 22 is adjacent to the bow and continues along the centerline (colinear with the x-axis of the hull's coordinate system) of the hull to a point 9.2 m from the bow (x=9.2 m). Transverse tubing member 24 traverses the hull parallel with the y-axis at a distance of 20 meters from the bow (x=20 m). Transverse tubing member 26 traverses the hull parallel with the y-axis at a distance of 110 m from the bow (x=110 m). Transverse tubing member 28 traverses the hull parallel with the y-axis at a distance of 200 m from the bow (x=200 m). In this example, the tubing members are configured to have a radius of 0.05 m, defined by a half cylinder. The transverse tubing members 24, 26, and 28 have a breadth of 0.007854 m and an area of 0.3406599 $m^2$. The centerline tubing member is configured to have an area of 0.189304 $m^2$. The specific dimensional locations and geometries of the tubing members are provided in FIG. 4. For all modeling reported with respect to Examples 1 and 2, continuous holes (or slots) in the tubing members were used to model the release of the anti-fouling solution. For embodiments to be built, tubing members having a plurality of openings or holes, rather than a continuous hole or slot, are considered to be the design of choice. The release velocity and volume release rates of anti-fouling composition from each tubing member are also provided in Table I.

As discussed above, the tubing configuration and the anti-fouling composition volume release rates indicated in FIG. 4 deliver a sodium hypochlorite concentration of at least 2 ppm over at least 60% of the surface of the vessel hull that is below the waterline. In terms of the 0.00200 kg sodium hypochlorite/kg seawater solution required to be released, the results of CFD modeling, based on the dispersion tubing configuration depicted in FIG. 4 and the assumptions stated for Example 1, demonstrate that an anti-fouling composition volume release rate of 2.8 $m^3/s$ is desirable.

TABLE I

| Tubing Member # | Release Velocity (m/s) | Volume Release Rate ($m^3/s$) |
|---|---|---|
| 22 | 2.5 | 0.8516 |
| 24 | 2.5 | 0.8516 |
| 26 | 1.5 | 0.5110 |
| 28 | 1.5 | 0.5110 |

where m/s = meters per second and $m^3/s$ = cubic meters per second

Figure 5:
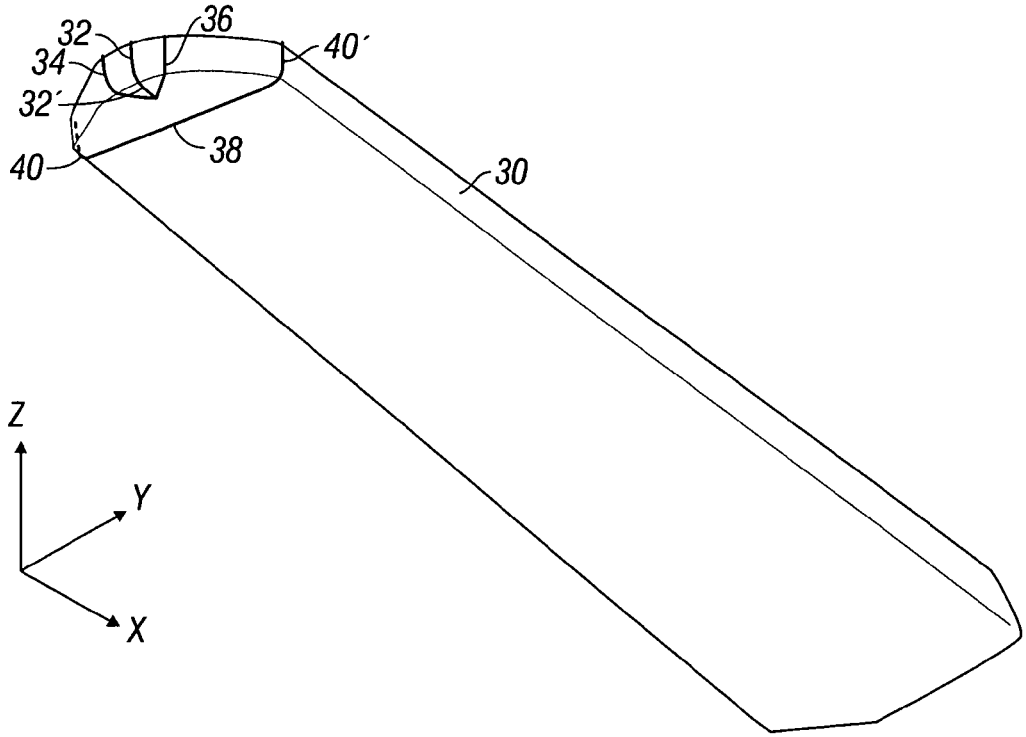
FIG. 5 is a depiction of an embodiment of an anti-fouling composition release system.

Example 2 describes the performance of an exemplary anti-fouling system for a water current velocity of 0.41 m/s and a hull draft of 9.0 m. In this modeled system as depicted in FIG. 5, a vessel hull 30 is provided with two generally vertical centerline tubing members 32 and 34 at the bow portion of the hull. An additional bow section tubing member 36 was also provided. Finally, a transverse tubing member is provided. In this example, all tubing members have a radius of 0.05 m, defined by a half cylinder, except the tubing member 32 coparallel with the centerline of the bow which was simulated by a strip. The centerline tubing member is divided into tubing members 32 and 32', tubing member 32 where the z-dimension is less than −5 m (area=0.03886 $m^2$) and 32' where the z-dimension is greater than −5 m (area=0.04155 $m^2$). Tubing members 34 and 36 configured at the bow as depicted in FIG. 5 have an area=0.1818 $m^2$. The transverse tubing member is divided into tubing members 38, 40, and 40' as depicted in FIG. 5. Tubing member 38 is used where x=20 m and y is less than 17 m (area=0.1333 $m^2$ and tubing members 40 and 40' are used where x=20 m and y is greater than 17 m (area=0.1347 $m^2$).

The release velocities and volume release rates of anti-fouling composition from each tubing member are provided in Table II.

TABLE II

| Tubing Member # | Release Velocity (m/s) | Volume Release Rate ($m^3/s$) |
|---|---|---|
| 32 | 0.6 | 0.02493 |
| 34 | 0.3 | 0.01165 |
| 36 | 0.5 | 0.09090 |
| 38 | 0.5 | 0.06735 |
| 40 | 0.1 | 0.00133 |

where m/s = meters per second and $m^3/s$ = cubic meters per second

The tubing configuration and release rates indicated in FIG. 5 deliver a sodium hypochlorite concentration of at least 2 ppm over at least 60% surface of the hull below the waterline. In terms of the 0.00200 kg sodium hypochlorite/kg seawater solution required to be released, the results of CFD modeling based on the tubing configuration depicted in FIG. 5 and the assumptions stated for Example 2, demonstrate that a solution volume release rate of 0.1961 $m^3/s$ is desirable. Therefore, for the conditions assumed, the modeling indicates the release tubing configuration depicted in FIG. 5 is more efficient at achieving a 2 ppm sodium hypochlorite concentration at the surface of the vessel hull than the configuration depicted in FIG. 4.

Examples 3-5

Modeling for Examples 3-5 was performed with the assumption that the vessel is moored with a spread moor that prohibits the vessel from rotating with the current flow and wind so that the angle of the current flow past the vessel hull varies. In Examples 3-5, a more extensive array of tubing members is provided as compared with the configurations modeled in Examples 1 and 2. Further, in Examples 3-5, modeling was performed with the assumption that the anti-fouling composition to be released has a concentration of sodium hypochlorite of 0.02 kg sodium hypochlorite/kg seawater. The more extensive array of tubing used in Examples 3-5 is designed to efficiently distribute the desired concentration of the anti-fouling composition to all areas of the hull under conditions of current flow offset angle ranging from −45 degrees to +45 degrees. Depending on the offset angle of the current flow, different release rates from different tubes in the array are required.

Figure 6:
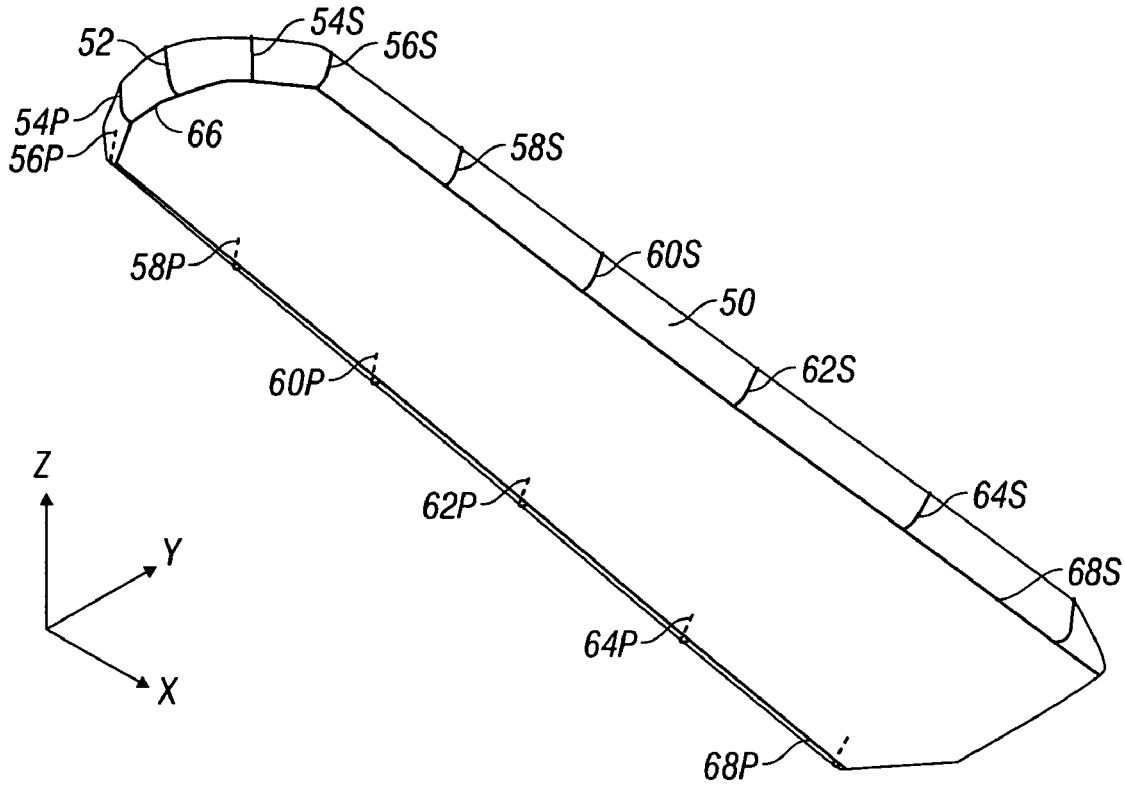
FIG. 6 is a depiction of an embodiment of an anti-fouling composition release system.

The dispersion tubing configuration used in Examples 3-5 is depicted in FIG. 6. In the system depicted in FIG. 6, a vessel hull 50 is provided with a vertical tubing member 52 at the centerline of the bow. On the starboard and port sides of the centerline, vertical tubing members 54S and 54P are provided. Five generally vertical tubing members 56S-64S are provided along the starboard side of the vessel hull and five generally vertical tubing members 56P-64P are provided along the port side of the vessel hull. Transverse tubing member 66 is provided along the bow. Finally horizontal tubing members 68S and 68P are provided along the starboard and port aft sides of the hull respectively.

The specific dimensional locations and geometries of the tubing members are depicted in FIG. 6. The diameters of the tubing members, the diameters of the openings in the tubing members, the spacing between the openings, and the total number of openings in each tubing member are provided in Table IX. The diameters of the tubing member are defined by a half circle. Tubing members 56S-64S and 56P-64P are rotated 20 degrees from vertical.

For a current offset angle of zero degrees relative to the centerline, a high release rate is used at transverse tubing member 66. Vertical tubing members will be used, but no release from horizontal tubing members 68P and 68S will be used, since an anti-fouling composition release at these locations would not be beneficial. For current offset angles other than zero degrees, both starboard and port vertical tubing members will be used. However, only one of horizontal tubing members 68P or 68S will be used. If the current is coming from the port side, only horizontal tubing member 68P, the vertical tubing members and tubing member 66 will be used. Horizontal tubing member 68S will not be used.

Example 3 describes the performance of an exemplary anti-fouling system for a current offset angle of 0 degrees and a current velocity of 0.53 m/s. The release velocities and volume release rates of anti-fouling composition from each tubing member are provided in Table III.

TABLE III

| Tubing Member # | x (m) | y (m) | Length (m) | Release Velocity (m/s) | Volume Release Rate ($m^3/s$) |
|---|---|---|---|---|---|
| 52 | 0.00 | 0.00 | 11.76 | 0.1000 | 0.0118 |
| 54S | 7.9 | 15.50 | 10.16 | 0.0060 | 0.0006 |
| 56S | Lower end of tubing member at the forward shoulder | | 11.73 | 0.0050 | 0.0006 |
| 58S | 65.00 | — | 11.73 | 0.0050 | 0.0006 |
| 60S | 110.00 | — | 11.73 | 0.0050 | 0.0006 |
| 62S | 155.00 | — | 11.73 | 0.0050 | 0.0006 |
| 64S | 200.00 | — | 11.73 | 0.0050 | 0.0006 |
| 66 | Upstream of forward shoulder | | 58.30 | 0.0900 | 0.0585 |
| 68P | Downstream of forward shoulder where flat of side begins | | 239.20 | 0.0000 | 0.0000 |
| 54P | 7.9 | 15.50 | 10.16 | 0.0060 | 0.0006 |
| 56P | Lower end of tubing member at the forward shoulder | | 11.73 | 0.0050 | 0.0006 |
| 58P | 65.00 | — | 11.73 | 0.0050 | 0.0006 |
| 60P | 110.00 | — | 11.73 | 0.0050 | 0.0006 |
| 62P | 155.00 | — | 11.73 | 0.0050 | 0.0006 |
| 64P | 200.00 | — | 11.73 | 0.0050 | 0.0006 |

TABLE III-continued

| Tubing Member # | x (m) | y (m) | Length (m) | Release Velocity (m/s) | Volume Release Rate ($m^3/s$) |
|---|---|---|---|---|---|
| 68S | Downstream of forward shoulder where flat of side begins | | 239.20 | 0.0000 | 0.0000 |

where m/s = meters per second, $m^3/s$ = cubic meters per second, S = starboard and P = port Under the conditions of Example 3, CFD modeling demonstrates that in terms of the volume of the 0.02 kg sodium hypochlorite/kg seawater solution required to be released to provide at least a 2 ppm sodium hypochlorite concentration over the surface of the hull below the waterline, a solution release rate of 0.0776 $m^3/s$ is desirable.

Example 4 describes the performance of an exemplary anti-fouling system for a current offset angle of 22.5 degrees and a current velocity of 0.53 m/s. The release velocities and volume release rates of anti-fouling composition from each tubing member are provided in the Table IV.

TABLE IV

| Tubing Member # | Release Velocity (m/s) | Volume Release Rates ($m^3/s$) |
|---|---|---|
| 52 | 0.0300 | 0.0035 |
| 54S | 0.0040 | 0.0004 |
| 56S | 0.0060 | 0.0007 |
| 58S | 0.0060 | 0.0007 |
| 60S | 0.0060 | 0.0007 |
| 62S | 0.0060 | 0.0007 |
| 64S | 0.0060 | 0.0007 |
| 66 | 0.0060 | 0.0039 |
| 68P | 0.0050 | 0.0132 |
| 54P | 0.0400 | 0.0043 |
| 56P | 0.0300 | 0.0036 |
| 58P | 0.0300 | 0.0036 |
| 60P | 0.0300 | 0.0036 |
| 62P | 0.0300 | 0.0036 |
| 64P | 0.0300 | 0.0036 |
| 68S | 0.0000 | 0.0000 |

where m/s = meters per second, $m^3/s$ = cubic meters per second, S = starboard and P = port Under the conditions of Example 4, CFD modeling demonstrates that, in terms of the 0.02 kg sodium hypochlorite/kg seawater solution required to be released to provide at least a 2 ppm sodium hypochlorite concentration over the surface of the hull below the waterline, a solution release rate of 0.0471 $m^3/s$ is desirable.

Example 5 describes the performance of an exemplary anti-fouling system for a current offset angle of 45 degree and a current velocity of 0.53 m/s. The release velocities and volume release rates of anti-fouling composition from each tubing member are provided in Table V.

TABLE V

| Tubing Member # | Release Velocity (m/s) | Volume Release Rates ($m^3/s$) |
|---|---|---|
| 52 | 0.0084 | 0.0010 |
| 54S | 0.0046 | 0.0005 |
| 56S | 0.0125 | 0.0015 |
| 58S | 0.0094 | 0.0011 |
| 60S | 0.0094 | 0.0011 |
| 62S | 0.0070 | 0.0008 |
| 64S | 0.0080 | 0.0010 |

TABLE V-continued

| Tubing Member # | Release Velocity (m/s) | Volume Release Rates ($m^3/s$) |
|---|---|---|
| 66 | 0.0072 | 0.0047 |
| 68P | 0.0060 | 0.0158 |
| 54P | 0.0300 | 0.0032 |
| 56P | 0.0300 | 0.0036 |
| 58P | 0.0300 | 0.0036 |
| 60P | 0.0300 | 0.0036 |
| 62P | 0.0300 | 0.0036 |
| 64P | 0.0300 | 0.0036 |
| 68S | 0.0000 | 0.0000 |

where m/s = meters per second, $m^3/s$ = cubic meters per second, S = starboard and P = port Under the conditions of Example 5, CFD modeling demonstrates that, in terms of the 0.02 kg sodium hypochlorite/kg seawater solution required to be released to provide at least a 2 ppm sodium hypochlorite concentration over the surface of the hull below the waterline, a solution volume release rate of 0.0490 $m^3/s$ is desirable.

For Examples 3-5, the ratio of the surface area covered with an at least 2 ppm sodium hypochlorite solution, the total solution volume release rate required to achieve the coverage, and the solution volume release rate from each pipe are shown in Table VI. In connection with the tubing member lengths in Table III, the flow rate per unit pipe length are calculated and shown in brackets.

Tables VI-IX demonstrate that as the current offset angle deviates from the centerline of the bow, the release of the anti-fouling composition from the various tubing members may be adjusted to provide the desired coverage of anti-fouling composition. The Tables also demonstrate that the diameters of the tubing members may be varied, while maintaining an effective volume release rate of the anti-fouling composition.

TABLE VI

| Current Direction | 0° | 22.5° | 45° |
|---|---|---|---|
| Percent of surface area covered with 2 ppm Sodium Hypochlorite | 0.9879 | 0.9961 | 0.9942 |
| Total Volume Release Rate of 0.02 kg sodium hypochlorite/kg seawater solution ($m^3/s$) | 0.0776 | 0.0471 | 0.0490 |

Solution volume release rates for tubing member (1000 * $m^3/s$) [Solution volume release rate/per tubing member length (1000 * $m^3/s/m$)]

| Tubing Member # | 0 degrees | | 22.5 degrees | | 45 degrees | |
|---|---|---|---|---|---|---|
| 52 | 11.800 | [1.003] | 3.540 | [0.301] | 0.991 | [0.084] |
| 54S | 0.642 | [0.063] | 0.428 | [0.042] | 0.492 | [0.048] |
| 56S | 0.605 | [0.052] | 0.726 | [0.062] | 1.513 | [0.129] |
| 58S | 0.605 | [0.052] | 0.726 | [0.062] | 1.137 | [0.097] |
| 60S | 0.605 | [0.052] | 0.726 | [0.062] | 1.210 | [0.103] |
| 62S | 0.605 | [0.052] | 0.726 | [0.062] | 0.968 | [0.083] |
| 64S | 0.605 | [0.052] | 0.726 | [0.062] | 0.968 | [0.083] |
| 66 | 52.000 | [0.892] | 3.900 | [0.067] | 4.680 | [0.080] |
| 68P | 0.000 | [0.000] | 13.190 | [0.055] | 15.828 | [0.066] |
| 54P | 0.642 | [0.063] | 4.280 | [0.421] | 3.210 | [0.316] |
| 56P | 0.605 | [0.052] | 3.630 | [0.309] | 3.630 | [0.309] |
| 58P | 0.605 | [0.052] | 3.630 | [0.309] | 3.630 | [0.309] |
| 60P | 0.605 | [0.052] | 3.630 | [0.309] | 3.630 | [0.309] |
| 62P | 0.605 | [0.052] | 3.630 | [0.309] | 3.630 | [0.309] |
| 64P | 0.605 | [0.052] | 3.630 | [0.309] | 3.630 | [0.309] |
| 68S | 0.000 | [0.000] | 0.000 | [0.000] | 0.000 | [0.000] |

here $m^3/s$ = cubic meters per second, S = starboard and P = port.

Table VII provides the flow rates from each opening in the tubing members, based on Table III and Table VI.

TABLE VII

Solution release rates from each opening (1000 * $m^3/s$/opening)

| Tubing Member # | Min q/opening | Max q/opening | # of Openings |
|---|---|---|---|
| 52 | 0.0168 | 0.2000 | 59 |
| 54S | 0.0084 | 0.0126 | 51 |
| 56S | 0.0103 | 0.0256 | 59 |
| 58S | 0.0103 | 0.0193 | 59 |
| 60S | 0.0103 | 0.0205 | 59 |
| 62S | 0.0103 | 0.0164 | 59 |
| 64S | 0.0103 | 0.0164 | 59 |
| 66 | 0.0161 | 0.1787 | 291 |
| 68P | 0.0111 | 0.0132 | 1196 |
| 54P | 0.0126 | 0.0839 | 51 |
| 56P | 0.0102 | 0.0615 | 59 |
| 58P | 0.0102 | 0.0615 | 59 |
| 60P | 0.0102 | 0.0615 | 59 |
| 62P | 0.0102 | 0.0615 | 59 |
| 64P | 0.0102 | 0.0615 | 59 |
| 68S | 0.0000 | 0.0000 | 146 |

where $m^3/s$ = cubic meters per second; S = starboard; P = port; Min q/opening = minimum solution volume release rate per opening in $m^3/s$; and Max q/opening = maximum solution volume release rate per opening in $m^3/s$.

Assuming 20 cm spacing between openings, 5 openings per meter are required. Each opening in the tubing members should be capable of releasing anti-fouling composition at rates approximately as shown in Table VII, but because the current can approach from either starboard or port, the above table can be condensed to the results provided in Table VIII.

TABLE VIII

Volume release rates from each opening (1000 * $m^3/s$/opening)

| Tubing Member # | Min q/opening | Max q/opening | # of Openings |
|---|---|---|---|
| 52 | 0.0168 | 0.2000 | 59 |
| 54(S, P) | 0.0084 | 0.0839 | 51 |
| 56(S, P) | 0.0103 | 0.0615 | 59 |
| 58(S, P) | 0.0103 | 0.0615 | 59 |
| 60(S, P) | 0.0103 | 0.0615 | 59 |
| 62(S, P) | 0.0103 | 0.0615 | 59 |
| 64(S, P) | 0.0161 | 0.0615 | 59 |
| 66 | 0.0161 | 0.1787 | 291 |
| 68(S, P) | 0.0111 | 0.0132 | 1196 |

where $m^3/s$ = cubic meters per second; S = starboard; P = port; Min q/opening = minimum solution volume release rate per opening in $m^3/s$; and Max q/opening = maximum solution volume release rate per opening in $m^3/s$.

Tubing members 66, 68S, and 68P have their anti-fouling composition inlets in the middle of the length of the tubing members to provide a more even release rate.

In general, it can be concluded that shorter tubing member length and smaller tubing member diameter increase the necessary pump head, but the volume release rate at the openings becomes more constant. Decreasing the distance between openings decreases necessary head, but the volume release rate at the openings becomes less constant.

Exemplary tubing member diameters, opening diameters, and spacing between openings were selected using the above conclusions, with the following goals in mind: (i) smaller tubing member diameter, (ii) lower head pressure, (iii) shorter distance between openings, and (iv) volume release rate at the openings as constant as possible. A summary of the results is shown in the following Table IX.

TABLE IX

| Tubing Member # | $D_{tube}$ [mm] | $D_{opening}$ [mm] | Opening spacing [mm] | # of Openings |
|---|---|---|---|---|
| 52 | 50 | 4 | 200 | 58 |
| 54(S, P) | 50 | 3 | 200 | 50 |
| 56-62(S, P) | 50 | 3 | 200 | 58 |
| 64(S, P) | 50 | 3 | 200 | 58 |
| 66 | 70 | 5 | 300 | 194 |
| 68(S, P) | 70 | 2.5 | 500 | 478 |

where $m^3/s$ = cubic meters per second; S = starboard; mm = millimeters; P = port; $D_{tube}$ = tube diameter in mm; and $D_{opening}$ = opening diameter in mm.

The horizontal tubing members differ from the remaining tubing members, as they require the inlet from the pump at the middle of the tubing member to decrease the flow rate in the tubing member. Therefore, the number of openings accounts for half the corresponding tubing member.

With respect to the various ranges set forth herein, any upper limit recited may be combined with any lower limit for selected sub-ranges.

Although the systems and processes described herein have been described in detail, it should be understood that various changes, substitutions, and alterations can be made without departing from the spirit and scope of the invention as defined by the following claims.

We claim:

1. A marine vessel having a first axis extending from the bow to the stern of the vessel hull and a second axis extending from the starboard to the port side of the vessel hull and a third axis extending from the waterline to the bottom of the vessel hull, comprising:

an underwater surface;

at least one tubing member extending along at least a portion of the first axis and at least one tubing member extending along at least a portion of the second axis or along at least a portion of the third axis of the vessel hull, the tubing members having a longitudinal axis and a plurality of openings disposed along the longitudinal axis of the tubing members, the tubing members being positioned adjacent to the underwater surface; and a means for supplying an anti-fouling composition to the underwater surface through the tubing members.

2. The marine vessel of claim 1, further comprising a production means for producing the anti-fouling composition.

3. The marine vessel of claim 1 wherein the anti-fouling composition comprises sodium hypochlorite or reaction products of sodium hypochlorite with water.

4. The marine vessel of claim 1 comprising a plurality of tubing members having a combined longitudinal dimension from about 0.006 $m/m^2$ of underwater surface area to 0.06 $m/m^2$ of underwater surface area.

5. The marine vessel of claim 1 comprising a plurality of tubing members having a plurality of openings disposed along the longitudinal axis of the tubing members, wherein the plurality of tubing members and the plurality of openings are configured such that the system is capable of delivering the anti-fouling composition at an effective dosage to at least 60% of the surface area of the underwater surface for a period of at least two minutes.

6. The marine vessel of claim 5, wherein the percentage of the surface area is determined using a computational fluid dynamics model.

7. The marine vessel of claim 5 wherein the anti-fouling composition is a solution of sodium hypochlorite capable of providing at least 0.2 ppm available chlorine to the underwater surface.

8. The marine vessel of claim 1 wherein the underwater surface is the surface of a vessel hull.

9. The marine vessel of claim 8 wherein the anti-fouling composition is generated on-board the vessel.

10. The marine vessel of claim 8 wherein an effective dosage of the anti-fouling composition is delivered to at least 75% of the surface area of the underwater vessel hull surface for a period of at least 60 minutes.

11. The marine vessel of claim 10 wherein the total number of the plurality of openings per square meter of underwater surface area of the vessel hull ranges from about 0.0915 opening per square meter of surface area to about 0.197 opening per square meter of surface area.

12. A process for delivering an anti-fouling composition to an underwater surface of a marine vessel having a first axis extending from the bow to the stern of the vessel hull and a second axis extending from the starboard to the port side of the vessel hull and a third axis extending from the waterline to the bottom of the vessel hull, comprising:

delivering an anti-fouling composition to the underwater surface at an effective, anti-fouling dosage to at least 60% of the surface area of the underwater surface for a period of at least two minutes, wherein the anti-fouling composition is delivered to the underwater surface through a plurality of openings disposed along at least one tubing member extending along at least a portion of the first axis and a plurality of openings disposed along at least one tubing member extending along at least a portion of the second axis or along at least a portion of the third axis of the vessel hull.

13. The process of claim 12 wherein said at least one tubing member comprises a plurality of tubing members having a combined longitudinal dimension from about 0.006 $m/m^2$ of underwater surface area to 0.06 $m/m^2$ of underwater surface area.

14. The process of claim 12 wherein the anti-fouling composition comprises sodium hypochlorite or reaction products of sodium hypochlorite with water.

15. The process of claim 14 wherein the anti-fouling composition is a sodium hypochlorite solution capable of providing at least 0.2 ppm available chlorine to the underwater surface.

16. The process of claim 12 wherein the underwater surface is the surface of a vessel hull.

17. The process of claim 16 wherein the anti-fouling composition is generated on-board the vessel.

18. The process of claim 17 wherein the effective dosage of the anti-fouling composition is delivered to at least 75% of the surface area of the underwater surface of the vessel hull for a period of at least 60 minutes.

19. A system for delivering an anti-fouling composition; comprising:

means for delivering an anti-fouling composition to at least one tubing member positioned adjacent to an underwater surface of a marine vessel having a first axis extending from the bow to the stern of the vessel and a second axis extending from the starboard to the port side of the vessel hull and a third axis extending from the waterline to the bottom of the vessel hull, wherein the at least one tubing member comprises a first portion that extends along the first axis and a second portion that extends along the second axis or along the third axis of the vessel hull, wherein the first and second portions include a plurality of openings of suitable size and at suitable locations such that the at least one tubing member is capable of delivering an effective dosage of the anti-fouling composition to at least 60% of the underwater surface.

20. The system of claim 19 comprising a plurality of tubing members having a combined longitudinal dimension from about 0.006 $m/m^2$ of underwater surface area to 0.06 $m/m^2$ of underwater surface area.

21. The system of claim 20 wherein the anti-fouling composition is a sodium hypochlorite solution capable of providing at least 0.2 ppm available chlorine to the underwater surface, and the underwater surface is at least a portion of an underwater surface of a vessel hull.

* * * * *